US008792815B2

(12) United States Patent
Tosuji

(10) Patent No.: US 8,792,815 B2
(45) Date of Patent: Jul. 29, 2014

(54) CLEANING DEVICE HAVING FIBER-BASED SCRAPING MEMBER

(75) Inventor: Kenta Tosuji, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 181 days.

(21) Appl. No.: 13/359,710

(22) Filed: Jan. 27, 2012

(65) Prior Publication Data

US 2012/0195663 A1 Aug. 2, 2012

(30) Foreign Application Priority Data

Jan. 28, 2011 (JP) ..... 2011-016346

(51) Int. Cl.
*G03G 21/00* (2006.01)

(52) U.S. Cl.
USPC ..... 399/353; 399/349; 399/357

(58) Field of Classification Search
USPC ..... 399/343, 349, 350–353, 357
See application file for complete search history.

(56) References Cited

U.S. PATENT DOCUMENTS

| | | | |
|---|---|---|---|
| 4,566,777 | A | 1/1986 | Honda et al. |
| 6,219,505 | B1 | 4/2001 | Sato et al. |
| 7,689,155 | B2 | 3/2010 | Fukuta |
| 2001/0028813 | A1 | 10/2001 | Nishimura et al. |
| 2001/0031154 | A1 | 10/2001 | Sato et al. |
| 2003/0049043 | A1 | 3/2003 | Fuwazaki et al. |
| 2005/0031373 | A1 | 2/2005 | Ishii |
| 2007/0025785 | A1 | 2/2007 | Fukuta |
| 2007/0065177 | A1 | 3/2007 | Yamashita et al. |
| 2009/0169258 | A1 | 7/2009 | Kamimura |
| 2010/0008706 | A1 * | 1/2010 | Sugiura et al. ..... 399/350 |

FOREIGN PATENT DOCUMENTS

| | | | |
|---|---|---|---|
| JP | 59-034545 | A | 2/1984 |
| JP | 09-319273 | A | 12/1997 |
| JP | 11-084973 | A | 3/1999 |
| JP | 2000-112312 | A | 4/2000 |
| JP | 2001-034131 | | 2/2001 |
| JP | 2003-066799 | | 3/2003 |
| JP | 2005-055771 | | 3/2005 |
| JP | 2005-250406 | A | 9/2005 |
| JP | 2005-250407 | A | 9/2005 |
| JP | 2007-033845 | A | 2/2007 |
| JP | 2007-079376 | A | 3/2007 |
| JP | 2007-086358 | A | 4/2007 |
| JP | 2009-157310 | | 7/2009 |

OTHER PUBLICATIONS

Notification of Reason for Refusal in corresponding Japanese Patent Application No. 2011-016346 mailed Dec. 25, 2012.

* cited by examiner

*Primary Examiner* — Hoang Ngo
(74) *Attorney, Agent, or Firm* — Banner & Witcoff, Ltd.

(57) ABSTRACT

A cleaning device includes: a collection member configured to contact a photosensitive member, on which an electrostatic latent image is configured to be formed, and collect foreign substances on the photosensitive member; a shaft configured to attract the foreign substances from the collection member so as to make the foreign substances cling thereto; a scraping member configured to contact the shaft and scrape the foreign substances cling on the shaft; and a housing configured to accommodate the collection member and the shaft, wherein the scraping member is mounted to the housing. The scraping member includes: an elastic member; and a fiber member configured to be adhered to the elastic member and slidingly contact the shaft. The elastic member is configured to press the shaft to such an extent that fibers of the fiber member are pressed and compressed.

8 Claims, 3 Drawing Sheets

CLEANING DEVICE HAVING FIBER-BASED SCRAPING MEMBER

CROSS-REFERENCE TO RELATED APPLICATIONS

This application claims priority from Japanese Patent Application No. 2011-016346 filed on Jan. 28, 2011, the entire subject matter of which is incorporated herein by reference.

TECHNICAL FIELD

The invention relates to a cleaning device for removing foreign substances attached to a photosensitive member of an image forming apparatus.

BACKGROUND

There have been known an image forming apparatus such as laser printer including: a developing device that accommodates therein toner; a photosensitive drum to which the toner is supplied via a developing roller of the developing device; and a cleaning device for removing foreign substances attached to a surface of the photosensitive drum. Specifically, the cleaning device includes: a first cleaning roller that contacts the photosensitive drum and captures the foreign substances on the photosensitive drum; a second clew oiler that makes the foreign substances captured by the first cleaning roller cling thereto; and a sponge scraper that scrapes the foreign substances cling on the second cleaning roller.

DETAILED DESCRIPTION

<General Overview>

Figure 1:
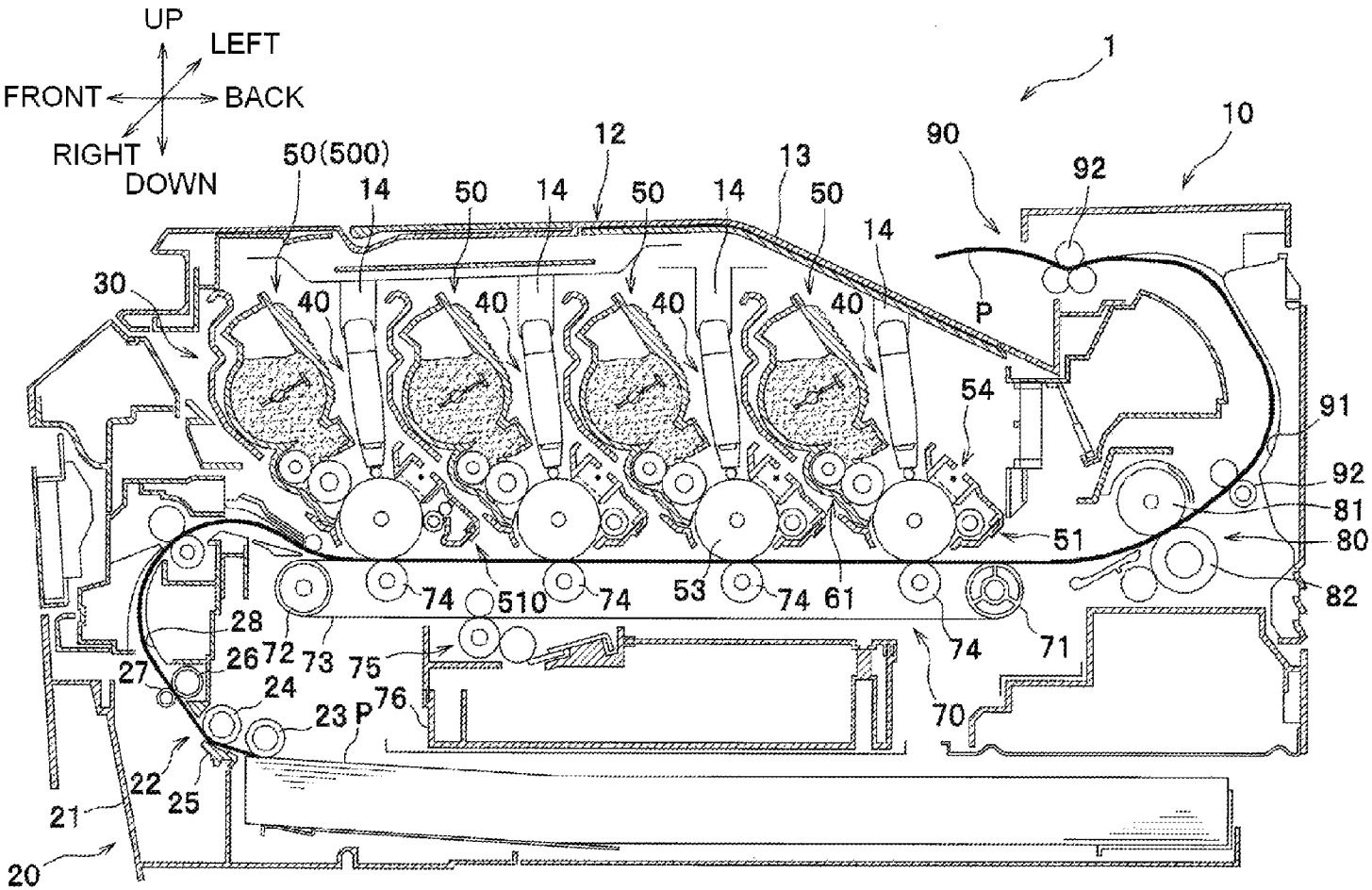
FIG. 1 is a side sectional view showing an image forming apparatus according to an exemplary embodiment of the invention.

According to the above-described related-art cleaning device, when silica, which is an external additive of the toner as the foreign substances, is collected, the silica restrained by the sponge scraper is deposited and is thus largely aggregated, which may escape between the sponge scraper and the second cleaning roller and return onto the photosensitive drum. When the aggregated silica returns to the photosensitive drum, it has a negative effect on a printing.

Accordingly, illustrative aspects of the invention provide a cleaning device that prevents foreign substances once collected from returning.

According to one illustrative aspect of the invention, there is provided a cleaning device comprising: a collection member configured to contact a photosensitive member, on which an electrostatic latent image is configured to be formed, and collect foreign substances on the photosensitive member; a shaft configured to attract the foreign substances from the collection member so as to make the foreign substances cling thereto; a scraping member configured to contact the shaft and serape the foreign substances cling on the shaft; and a housing configured to accommodate the collection member and the shaft, wherein the scraping member is mounted to the housing, wherein the scraping member comprises: an elastic member; and a fiber member configured to be adhered to the elastic member and slidingly contact the shaft, and wherein the elastic member is configured to press the shaft to such an extent that fibers of the fiber member are pressed and compressed.

According to the above-described cleaning device, since the fibers of the fiber member are closely-packed between the shaft and the elastic member without a gap, the silica is deposited with being entangled with the fibers. Thereby, even when the deposited silica tries to escape, it is possible to restrain the silica by the entangled fibers.

Further, according to another illustrative aspect of the invention, there is provided a cartridge removably mounted to an image forming apparatus, the cartridge comprising: a photosensitive member on which an electrostatic latent image is configured to be formed; the cleaning device; and a housing configured to accommodate the photosensitive member and the cleaning device.

According to the illustrative aspects of the invention, the cleaning device can securely collect the foreign substances without the return thereof.

<Exemplary Embodiments>

Exemplary embodiments of the invention will now be described with reference to the drawings. In the following descriptions, an overall configuration of an image forming apparatus 1 to which a developing device having a cleaning device of the invention is mounted will be briefly described, and then characteristic parts of the invention will be specifically described. A color printer is one example of the image forming apparatus 1.

Incidentally, in the following descriptions, directions are described, based on a user who is using the image forming apparatus 1. That is, the left side of FIG. 1 is referred to as the 'front side,' the right side is referred to as the 'rear side,' the inner side of the direction perpendicular to the paper sheet is referred to as the 'left side' and the front side of the direction perpendicular to the paper sheet is referred to as the 'right side.' Also, the upper and lower directions of the paper sheet are referred to as the 'upper-lower direction.'

(Overall Configuration of Image Forming Apparatus)

As shown in FIG. 1, the image forming apparatus 1 includes, in a main body housing 10, a feeder unit 20 that feeds a sheet P (one example of a recording sheet), an image forming unit 30 that forms an image on the fed sheet P, and a sheet discharge unit 90 that discharges the sheet P on which the image is formed.

An upper cover 12, which can be opened and closed, is provided to an upper part of the main body housing 10. An upper surface of the upper cover 12 is configured as a sheet discharge tray 13 on which the sheets P discharged from the main body housing 10 are stacked. A plurality of holding members 14, each of which holds an LED unit 40, is provided below a lower surface of the upper cover, The feeder unit 20 includes: a sheet feeding tray 21 that is provided at a lower part in the main body housing 10 and is detachably mounted to the main body housing 10; and a sheet feeding mechanism 22 that conveys the sheet P from the sheet feeding tray 21 to the image forming unit 30. The sheet feeding mechanism 22 is provided at the front side of the sheet feeding tray 21. The sheet feeding mechanism 22 includes a sheet feeding roller 23, a separation roller 24 and a separation pad 25.

In the feeder unit 20, the sheets P in the sheet feeding tray 21 are separated and sent upwards one at a time, and paper dusts are removed while the sheet passes between a paper dust capturing roller 26 and a pinch roller 27. Then, the sheet passes through a conveyance path 28, a conveyance direction thereof is changed so that the sheet is conveyed toward backward, and is then fed to the image forming unit 30.

The image forming unit 30 includes four LED units 40, four process cartridges 50, a transfer unit 70 and a fixing unit 80.

Figure 2:
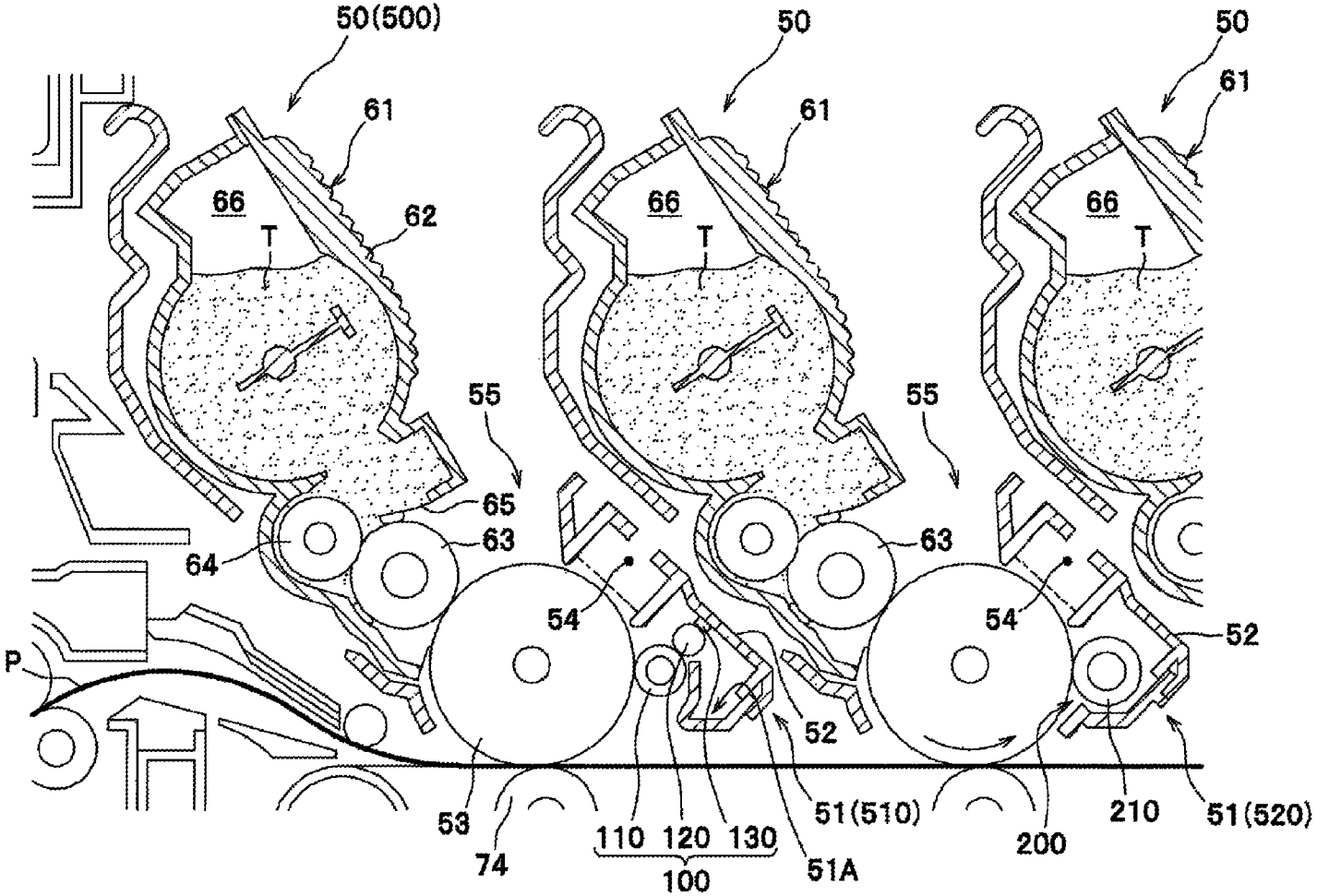
FIG. 2 is an enlarged sectional view showing a structure of a process cartridge.

The process cartridges 50 are arranged side by side in the front-rear direction between the upper cover 12 and the feeder unit 20. As shown in FIG. 2, each process cartridge 50 includes a drum unit 51 and a developing cartridge 61 (one example of a developing unit) that is detachably attached to the drum unit 51.

Incidentally, each developing cartridge 61 has the same configuration, except that colors of toner T (one example of developer) to be accommodated in toner accommodation chambers 66, are different. In this exemplary embodiment, the black toner is accommodated in the developing cartridge 61 of the process cartridge 500 that is arranged at the most upstream side in the conveyance direction of the sheet P.

The drum units 51 have the same configuration, except for a part of the drum unit 510 that is arranged at the most upstream side in the conveyance direction of the sheet P. Incidentally, the differences between the drum unit 501 of the process cartridge 500 that is arranged at the most upstream side in the conveyance direction of the sheet P and the other drum unit 520 will be specifically described later.

A drum frame 52 (one example of a housing) is configured so that an exposure hole 55 facing a photosensitive drum 53 (one example of a photosensitive member) from the outside is formed as the developing cartridge 61 is mounted. The LED unit 40 is inserted into the exposure hole 55 with facing an upper surface of the photosensitive drum 53.

The developing cartridge 61 includes a developing frame 62, a developing roller 63 and a supply roller 64 which are rotatably supported to the developing frame 62, and a layer thickness regulation blade 65. The developing cartridge 61 has the toner accommodation chamber 66 in which the toner T is accommodated.

As shown in FIG. 1, the transfer unit 70 is provided between the feeder unit 20 and the respective process cartridges 50. The transfer unit 70 includes a driving roller 71, a driven roller 72, a conveyance belt 73, transfer rollers 74 and a cleaning unit 75.

The driving roller 71 and the driven roller 72 are spaced in the front rear direction and arranged in parallel, and the conveyance belt 73 consisting of an endless belt tightly extends between the driving roller 71 and the driven roller 72. An outer surface of the conveyance belt 73 abuts on the respective photosensitive drums 53. The four transfer rollers 74 that hold the conveyance belt 73 between the respective photosensitive drums 53 and the transfer rollers 74 are arranged on an inner side of the conveyance belt 73 with opposed to the respective photosensitive drums 53. The transfer rollers 74 are applied with a transfer bias by constant current control at the time of transfer.

The cleaning unit 75 is arranged below the conveyance belt 73. The cleaning unit 75 is configured to remove the toner attached to the conveyance belt 73 and to drop the removed toner into a toner storage unit 76 arranged below the cleaning unit.

The fixing unit 80 is arranged at the rear side of the respective process cartridges 50 and the transfer unit 70. The fixing unit 80 includes a heating roller 81 and a pressing roller 82 that is opposed to the heating roller 81 and presses the heating roller 81.

In the imaging forming unit 30, the surfaces of the respective photosensitive drums 53 are positively charged uniformly by chargers 54 and are then exposed by lights illuminated from the respective LED units 40. Thereby, potentials of the exposed parts are lowered, so that electrostatic latent images based on in age data are formed on the respective photosensitive drums 53.

Also, the toner in the toner accommodation chamber 66 is supplied to the developing roller 63 by rotation of the supply roller 64 and is introduced between the developing roller 63 and the layer thickness regulation blade 65 by rotation of the developing roller 63, so that the toner is carried on the developing roller 63, as a thin layer having a predetermined thickness. Here, the toner carried on the developing roller 63 is positively friction-charged between the supply roller 64 and the developing roller 63 and between the developing roller 63 and the layer thickness regulation blade 65.

The toner carried on the developing roller 63 is supplied to the electrostatic latent image formed on the photosensitive drum 53 when the developing roller 63 faces and contacts the photosensitive drum 53. Thereby, the toner is selectively carried on the photosensitive drum 53, so that the electrostatic latent image becomes visible and a toner image is thus formed by reversal development.

Then, as the sheet P fed onto the conveyance belt 73 passes between the respective photosensitive drums 53 and the respective transfer rollers 74 arranged on the inner side of the conveyance belt 73, the toner images formed on the respective photosensitive drums 53 are transferred to the sheet P. When the sheet P passes between the heating roller 81 and the pressing roller 82, the toner images transferred to the sheet P are heat-fixed.

The sheet discharge unit 90 includes: a conveyance path 91 that is formed to extend upward from an exit of the fixing unit 80 and to turn around forward; and a plurality of pairs of conveyance rollers 92 conveying the sheet P. The sheet P, on which the toner images are formed, is conveyed through the sheet discharge-side conveyance path 91 by the conveyance rollers 92, discharged to the outside of the main body housing 10 and stacked on the sheet discharge tray 13.

(Detailed Structure of Cleaning Device)

A first cleaning device 100 and a second cleaning device 200 will now be specifically described.

As shown in FIG. 2, the first cleaning device 100 is provided only to the drum unit 510 that is arranged at the most upstream side in the conveyance direction of the sheet P. The first cleaning device 100 includes a cleaning roller 110, a shaft 120 and a scraping member 130.

The cleaning roller 110 (one example of a collection member) is accommodated in the drum frame 52. The cleaning roller 110 is rotatably provided to contact the photosensitive drum 53 and temporarily collects foreign substances D attached on the photosensitive drum 53, such as paper dusts, toner, silica that is an external additive of the toner, and the like.

Specifically, a negative voltage is applied to the cleaning roller 110 during the printing, so that the cleaning roller 110 attracts and holds the toner that remains positively charged on the photosensitive drum 53 without being transferred to the sheet P from the photosensitive drum 53.

Then, a positive voltage that is higher than a potential on the surface of the photosensitive drum 53 is applied to the cleaning roller 110 at a predetermined timing except for the printing, so that the toner held on the cleaning roller 110 is returned to the photosensitive drum 53. Incidentally, at this time, the positive voltage higher than the surface potential of the developing roller 63 is applied to the photosensitive drum 53, so that the positively charged toner is collected to the developing roller 63 from the photosensitive drum 53.

Also, at this time, the negatively charged paper dusts attached on the photosensitive drum 53 are attracted and held to the cleaning roller 110 to which the positive voltage is applied.

The shaft 120 is accommodated in the drum frame 52 and is rotatably mounted obliquely upward to the rear of the cleaning roller 110. The shaft 120 attracts the paper dusts held on the cleaning roller 110 and makes the paper dusts cling to the shaft 120. Specifically, when performing the printing, a negative voltage which absolute value is smaller than the negative voltage applied to the cleaning roller 110 is applied to the shaft 120. Thereby, since a potential of the shaft 120 becomes higher than that of the cleaning roller 110, the toner positively charged on the cleaning roller 110 is favorably held on the cleaning roller 110 without being moved to the shaft 120 having the higher potential.

Also, at the predetermined timing except for the printing, the positive voltage higher than the positive voltage applied to the cleaning roller 110 is applied to the shaft 120. Thereby, since the potential of the shaft 120 becomes higher than that of the cleaning roller 110, the toner remaining on the cleaning roller 110 is not moved to the shaft 120 and the negative paper dusts cling on the cleaning roller 110 are attracted and held to the shaft 120 having the higher potential.

Figure 3:
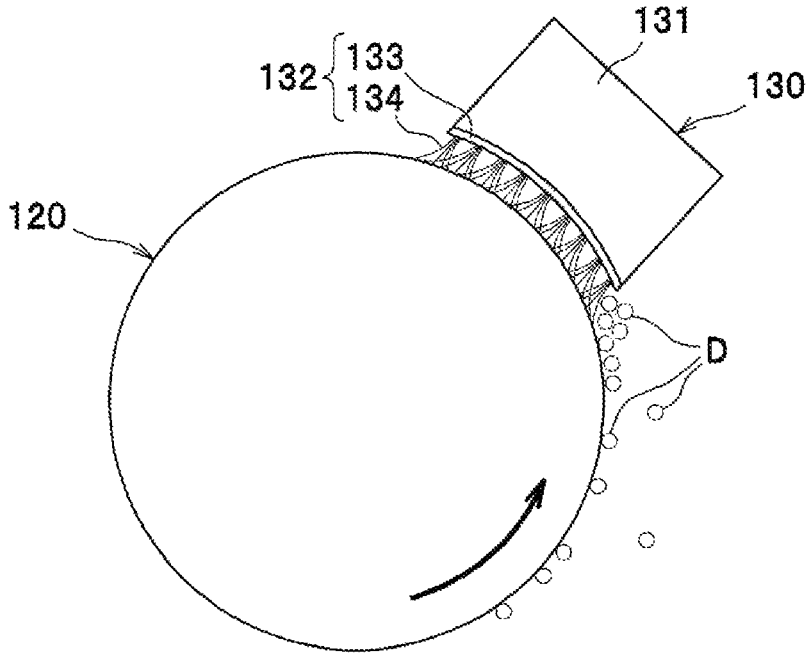
FIG. 3 is an enlarged view of a shaft and a scraping member.

As shown in FIG. 3, the scraping member 130 includes a sponge 131 (one example of an elastic member) and a fiber transplant member 132 (one example of a fiber member) adhered to the sponge 131 The scraping member 130 is mounted obliquely upward to the rear of the shaft 120 so as to slidingly contact the surface of the shaft 120. Accordingly, the paper dusts cling on the shaft 120 are scraped and then fallen downwards by the scarping member 130. Incidentally, a cylindrical foreign substance collection part 51A having a bottom for receiving the falling paper dusts is formed below the scraping member 130, as a part of the drum unit 510 (refer to FIG. 2).

The sponge 131 is attached to the drum frame 52. The sponge 131 is configured to press the shaft 120 via the fiber transplant member 132. When the fiber transplant member 132 is pressed by the sponge 131, the sponge 131 is easily deformed by repulsive force that is applied to the fiber transplant member 132 from the shaft 120, so that the fiber transplant member 132 becomes a shape (i.e., an arc-like shape) following the shaft 120. Thus, the force that is applied per unit area of the fiber transplant member 132 is not excessively increased, compared to a case where a rubber and the like are used.

The fiber transplant member 132 is a member having a base 133 and a plurality of fiber bundles 134 densely transplanted to the base 133. The base 133 is adhered to the sponge 131, and the fiber bundles 134 extend from the base 133 toward the shaft 120. The fiber transplant member 132 is pressed to the shaft 120 by the sponge 131 so that the fiber bundles 134 are pressed and compressed. Thereby, since the fiber bundles 134 are closely-packed between the shaft 120 and the sponge 131 without a gap, it is possible to securely restrain the foreign substances D.

As shown in FIG. 2, the second cleaning device 200 is provided to each of the three drum units 51 except for the most upstream drum unit 510. The second cleaning device 200 includes a cleaning roller 210. The cleaning roller 210 is rotatably mounted so as to slidingly contact the photosensitive drum 53. The cleaning roller 210 is configured to temporarily collect the toner attached on the photosensitive drum 53 as the same voltage as the cleaning roller 110 of the first cleaning device 100 is applied thereto.

The operations and effects of the image forming apparatus 1 having the above configuration will now be described.

As shown in FIG. 2, when the image forming apparatus 1 is enabled to execute the printing operation, the sheet P is conveyed between the respective photosensitive drums 53 and the transfer rollers 74 and the toner images of respective colors are transferred to the sheet P therebetween. At this time, in the most upstream process cartridge 500, the toner remaining on the photosensitive drum 53 without being transferred to the sheet P is collected by the cleaning roller 110, which is positioned downstream from the rotating direction of the photosensitive drum 53 and is negatively charged. Here, as described above, since the shaft 120 is applied with the negative voltage which absolute value is smaller than the negative voltage applied to the cleaning roller 110, the toner collected to the cleaning roller 110 is held at the cleaning roller 110 without being moved to any of the photosensitive drum 53 and the shaft 120.

Also, at this time, when the negatively-charged paper dusts are made from the sheet P, the paper dusts are attached on the positively-charged photosensitive drum 53. Then, the paper dusts on the photosensitive drum 53 are moved with being attached on the photosensitive drum 53, without moving to the negatively-charged cleaning roller 110.

At the predetermined timing (for example, just after the printing has completed) except for the printing, the positive voltage higher than the surface potential of the photosensitive drum 53 is applied to the cleaning roller 110, and the positive voltage higher than the voltage applied to the cleaning roller 110 is applied to the shaft 120 as described above. Thereby, the toner on the cleaning roller 110 is moved onto the photosensitive drum 53 and carried by the photosensitive drum 53, so that the toner is collected by the developing roller 63 having the potential lower than that of the photosensitive drum 53.

Also, at this time, the negatively-charged paper dusts held on the photosensitive drum 53 are moved onto the positively-charged cleaning roller 110 and then moved onto the shaft 120 having the potential higher than that of the cleaning roller 110. At this time, in addition to the paper dusts, the toner, the silica that is the filler of the toner and the like attached to the cleaning roller 110 may be electrically or physically cling to the shaft 120. The foreign substances D on the shaft, such as paper dusts, toner and silica, are scraped and dropped downward by the scraping member 130 and received in the foreign substance collection part 51A, as shown in FIG. 3.

In this exemplary embodiment, the scraping member 130 is configured by the sponge 131 and the fiber transport member 132, so that the fiber bundles 134 of the fiber transport member 132 are closely-packed between the shaft 120 and the sponge 131 without a gap. Hence, it is possible to securely restrain the foreign substances D. A part of the silica in the restrained foreign substances D is deposited on the shaft 120 at an upstream end of the fiber transport member 132 in the rotating direction of the shaft 120, without falling into the foreign substance collection part 51A. However, since the deposited silica is deposited with being entangled with the fiber bundles 134, the silica does not escape between the shaft 120 and the scraping member 130. Thereby, it is possible to keep the once collected foreign substances D from returning onto the photosensitive drum 53.

Although the exemplary embodiment has been described, the invention is not limited thereto. The specific configuration can be appropriately changed without departing from the gist of the invention.

In the above-described exemplary embodiment, the fiber transport member 132 has been described as an example of the fiber member. However, the invention is not limited thereto. For example, felt, pile and the like may be used as the fiber member.

In the above-described exemplary embodiment, the sponge 131 has been described as an example of the elastic member. However, the invention is not limited thereto. For example, a rubber may be adopted as the elastic member.

In the above-described exemplary embodiment, the shaft 120 and the scraping member 130 have been provided only to the most upstream drum unit 510. However, the invention is not limited thereto. For example, the shaft 120 and the scraping member 130 may be provided to all the drum units 51.

In the above-described exemplary embodiment, the photosensitive drum 53 has been adopted as the photosensitive member. However, the invention is not limited thereto. For example, a belt-type photosensitive member may be adopted.

In the above-described exemplary embodiment, the invention has been applied to the image forming apparatus 1. However, the invention is not limited thereto. For example, the invention can be also applied to the other image forming apparatuses, for example copier, complex machine and the like.

What is claimed is:

1. A cleaning device comprising:

a collection member configured to contact a photosensitive member, on which an electrostatic latent image is configured to be formed, and to collect foreign substances from the photosensitive member;

a shaft configured to attract the foreign substances from the collection member so as to make the foreign substances cling thereto;

a scraping member configured to contact the shaft and scrape the foreign substances clinging onto the shaft; and a housing configured to accommodate the collection member and the shaft, wherein the scraping member is mounted to the housing, wherein the scraping member comprises:

an elastic member; and a fiber member configured to be adhered to the elastic member and slidingly contact the shaft, wherein the fiber member is a member to which fibers are transplanted, and wherein the elastic member is configured to press the shaft to such an extent that the fibers of the fiber member are pressed and compressed.

2. The cleaning device according to claim 1, wherein the elastic member is a sponge.

3. The cleaning device according to claim 1, wherein when the elastic member presses the shaft via the fiber member, the elastic member is deformable by repulsive force applied to the fiber member from the shaft so that the fiber member conforms to a shape of the shaft.

4. A cartridge removably mountable to an image forming apparatus, the cartridge comprising:

a photosensitive member on which an electrostatic latent image is configured to be formed;

a cleaning device comprising:

a collection member configured to contact the photosensitive member and to collect foreign substances from the photosensitive member;

a shaft configured to attract the foreign substances from the collection member so as to make the foreign substances cling thereto; and a scraping member configured to contact the shaft and scrape the foreign substances clinging onto the shaft; and a housing configured to accommodate the photosensitive member and the cleaning device, wherein the scraping member is mounted to the housing, wherein the scraping member comprises:

an elastic member; and a fiber member configured to be adhered to the elastic member and slidingly contact the shaft, wherein the fiber member is a member on which fibers are transplanted, and wherein the elastic member is configured to press the shaft to such an extent that the fibers of the fiber member are pressed and compressed.

5. The cartridge according to claim 4, wherein the elastic member is a sponge.

6. The cartridge according to claim 4, wherein when the elastic member presses the shaft via the fiber member, the elastic member is deformable by repulsive force applied to the fiber member from the shaft so that the fiber member conforms to a shape of the shaft.

7. The cartridge according to claim 4, further comprising:

a toner accommodation chamber configured to accommodate toner; and a supply roller configured to supply the toner to the photosensitive member from the toner accommodation chamber.

8. The cartridge according to claim 7, further comprising a developing cartridge removably mountable to the housing, wherein the developing cartridge comprises the toner accommodation chamber and the supply roller.

* * * * *